US005332283A

United States Patent [19]

Gray

[11] Patent Number: 5,332,283

[45] Date of Patent: Jul. 26, 1994

[54] THREE LEGGED FOLDING CHAIR

[76] Inventor: Donald F. Gray, 5992 Seymour Rd., Owosso, Mich. 48867

[21] Appl. No.: 910,684

[22] Filed: Jul. 8, 1992

[51] Int. Cl.[5] ..... A47C 4/00

[52] U.S. Cl. ..... 297/58; 297/16.2; 297/129

[58] Field of Search ..... 297/58, 55, 48, 16, 297/129, 183, 16.2

[56] References Cited

U.S. PATENT DOCUMENTS

| | | | |
|---|---|---|---|
| 1,296,905 | 3/1919 | Baker | 297/58 |
| 1,314,830 | 9/1919 | Parsons | 297/58 |
| 2,346,989 | 4/1944 | O'Brien . | |
| 2,380,437 | 7/1945 | Homrighausen | 297/55 |
| 2,480,402 | 8/1949 | Elston | 297/129 |
| 2,629,429 | 2/1953 | Baumfeld | 297/58 |
| 3,420,571 | 1/1969 | Moore . | |
| 3,638,538 | 2/1972 | Abbott . | |
| 3,802,734 | 4/1974 | Lindley . | |
| 3,997,213 | 12/1976 | Smith et al. . | |
| 4,047,752 | 9/1977 | Rohr . | |
| 4,676,548 | 6/1987 | Bradbury . | |
| 4,836,938 | 1/1988 | Kobasic | 297/129 |
| 4,889,387 | 12/1989 | Gregory . | |
| 5,016,792 | 5/1991 | Jay | 297/129 |

FOREIGN PATENT DOCUMENTS

| | | | |
|---|---|---|---|
| 666960 | 2/1952 | United Kingdom | 297/58 |

*Primary Examiner*—Flemming Saether

*Attorney, Agent, or Firm*—Learman & McCulloch

[57] ABSTRACT

The folding chair (10) includes V-shaped main support frame (12) with an apex (28) and two legs (22 and 24) with free ends. A V-shaped seat support frame (14) has an apex (40) and two arms (34 and 36) with free ends. The V-shaped seat support frame (14) is pivotally attached to the main support frame (12) by pivot pins (48 and 50) which allow pivotal movement between a position in which both V-shaped frames (12 and 14) are in a common plane and a position in which the seat support frame (14) is in a plane that is generally perpendicular to the plane through the main support frame (12). A third leg (16) is pivotally attached to the V-shaped main support frame (12) near its apex. The third leg (16) is connected to the apex portion (40) of the V-shaped seat support frame (14) by a pin member (66) and holds the seat support frame in a fixed position relative to the V-shaped main support frame. The pin (66) is removed to allow both V-shaped support frames (12 and 14) and the third leg (16) to fold flat and into a common plane. A back rest (20) is secured to the apex (40) of the V-shaped main support frame (12). A support seat (18) is attached to the free ends of the arms (34 and 36). The pivot pins (48 and 50) pass through conical bores (52 and 54). Shoulder straps (86 and 88) are provided for carrying the chair (10). Hooks (94) can be provided for attaching a backpack to the chair and carrying brackets (96) can be provided for attaching other equipment to the chair.

20 Claims, 3 Drawing Sheets

THREE LEGGED FOLDING CHAIR

TECHNICAL FIELD

This invention is in a chair and more particularly in a folding chair for hunters, ice fisherman and others that can be carried on a person's back with shoulder straps.

BACKGROUND OF THE INVENTION

Hunters, ice fisherman and other individuals need comfortable chairs that allow them to sit for hours at a time with minimal movement while remaining alert and ready to spring into action at any time. Such chairs should be stable on uneven surfaces. There should be cushions for comfort and for warmth in cold weather. Such chairs should be light weight, easy to carry and should not interfere with other equipment which must be carried.

Some chairs that have been used have a webbing or fabric covers supported by a rectangular framework. These chairs tend to become uncomfortable causing the person using the chair to shift positions frequently after sitting in them for a period of time. Such chairs also tend to be cold. When a person sits in them, his protective clothing is compacted forcing the air out and thereby increasing the rate of heat transfer through the clothing and the chair.

Chairs with four legs or that include horizontal support surfaces tend to be unstable on rough or uneven surfaces. Chairs with horizontal bar members attached to both ends to two chair legs tend to rock on rough surfaces. There is also a tendency for the bar members to bend and deform the chair legs.

Chairs are used by hunters that are either attached to a tree or are leaned against a tree. Such chairs require a tree with the right size trunk and with limbs that are properly spaced. If there are a number of limbs close to the ground it may be impossible to use a chair that is designed to be leaned against a tree trunk. A search for a tree that has the required features and desirable location will in some cases take time. In other cases it will be impossible to find a suitable tree. Hunters of animals that live on tundra and ice fisherman for example cannot use chairs that are to be attached to or leaned against trees.

Chairs that convert into carts or even travoises are known. Such chairs may work very well in some circumstances but not in other circumstances. Carts and travoises do not work well in rough terrain for example. Chairs that convert into carts or travoises are larger and weigh more than chairs that are not convertible. Chairs that are convertible are therefore undesirable except in the situations in which the device they convert into is also needed.

Chairs require a support structure made from rigid members. A folding chair still has rigid members after it is folded into a compact package for storage or transport. In order to carry such a chair after it is folded for transport, it is often necessary to provide special padding or to support and hold the chair away from a person's body to prevent discomfort.

SUMMARY OF THE INVENTION

An object of the invention is to provide a stable folding chair with three legs.

Another object of the invention is to provide a folding chair with shoulder straps for carrying.

A further object of the invention is to provide a folding chair having a padded seat, a padded backrest and shoulder straps that folds so that the seat and backrest pads contact the body of a person carrying the chair with the shoulder straps.

A still further object of the invention is to provide a folding chair with a frame that folds into one generally flat plane.

The folding chair includes a V-shaped main frame with an apex and two legs with free ends. A V-shaped seat support frame with an apex and two arms with free ends. The V-shaped seat support frame is pivotally attached to the main frame and is pivotal relative to the main frame from a position in which the seat support frame is in a plane that is generally perpendicular to a plane through the main frame to a position in which the V-shaped seat support frame is inside the main support frame and in a common plane with the main support frame. A back support cushion is attached to the V-shaped main support frame adjacent to the apex. A seat cushion is attached to the V-shaped seat support frame adjacent to the free ends of its legs. A third leg is pivotally attached to the V-shaped main support frame near its apex. The third leg is connected to the apex portion of the V-shaped seat support frame by a pin member and holds the seat support frame in a fixed position relative to the main support frame. The pin member can be removed to allow the V-shaped main frame, the V-shaped seat support frame and the third leg to fold into a generally common plane.

Further objects, features and other aspects of this invention will be understood from the following detailed description of a preferred embodiment thereof as illustrated in the accompanying drawings.

DESCRIPTION OF THE PREFERRED EMBODIMENT

Figure 3:
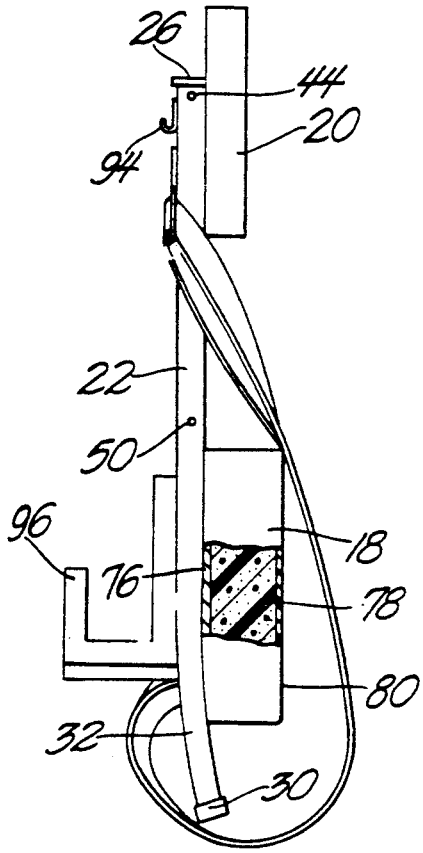
FIG. 3 is a side elevational view of a three legged folding chair in a folded condition.

The three legged folding chair 10 includes a V-shaped main support frame 12, a V-shaped seat support frame 14, a third leg 16, a support seat 18 and a back rest 20. The V-shaped main support frame 12 has a right leg 22, a left leg 24 and an angle member 26 welded to the upper ends of the right and left legs 22 and 24 to form an apex 28. The right and left legs 22 and 24 extend downwardly and outwardly relative to each other from the apex 28. The free ends of the right and left legs 22 and 24 have non-skid members 30 attached. The right leg 22 and the left leg 24 as shown in FIG. 3 are both in a common generally vertical plane except for the free ends of the legs. The free ends of the legs 22 and 24 are bent forward at 32 to provide better weight distribution and improved stability for the chair 10. The right and left legs 22 and 24 are preferably made from tubular aluminum with a rectangular cross section.

Figure 4:
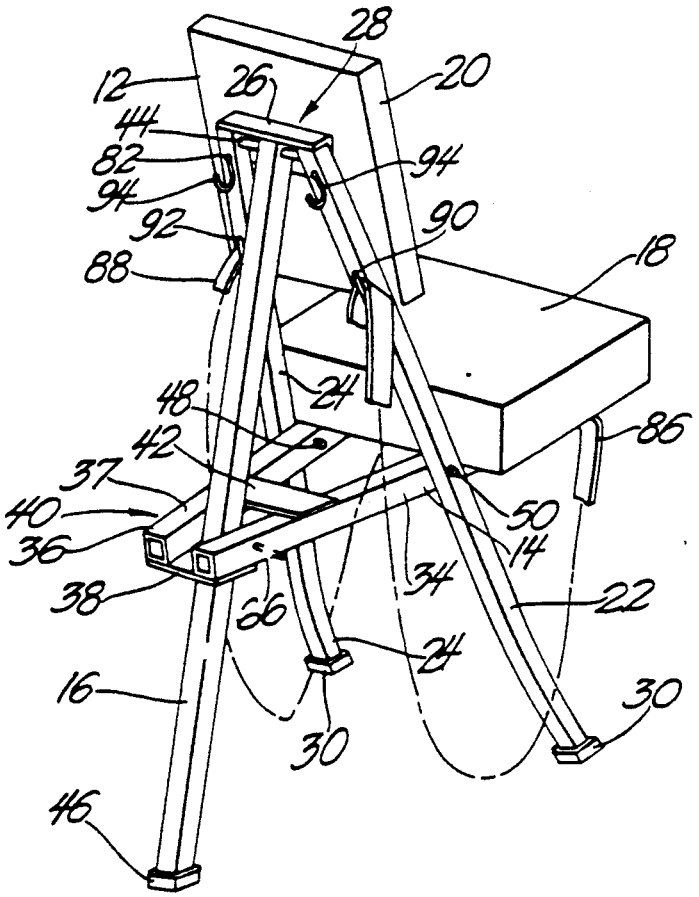
FIG. 4 is a perspective view of a three legged folding chair in an unfolded condition ready for use as a chair.
Figure 5:
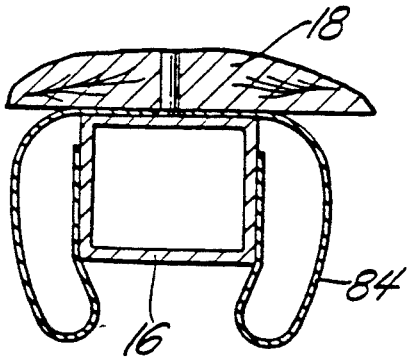
FIG. 5 is an enlarged sectional view taken along line 5—5 in FIG. 2.

A V-shaped seat support frame 14 has a right arm 34, a left arm 36 and a plate 38 welded to the rear ends of the right and left arms 34 and 36 to form an apex 40. The right arm 34 and the left arm 36 extend forwardly and outwardly from the plate 38 as shown in FIG. 4. The right arm 34 and the left arm 36 are aluminum tubes with a rectangular cross section. The plate 38 is welded to the lower surface 35 of the right and left arms 34 and 36. A second plate 42 is welded to the upper surface 37 of the right and left arms 34 and 36 and is spaced some distance away from the plate 38.

The third leg 16 is pivotally attached to the V-shaped main frame 12 by a pin 44. The pin 44 is secured to the apex 28 of the V-shaped main frame 12 adjacent to the angle member 26. Spacers 45 on the pin 44 center the third leg 16 between the right leg 22 and the left leg 24. A non-skid member 46 is attached to the free end of the third leg 16.

Figure 6:
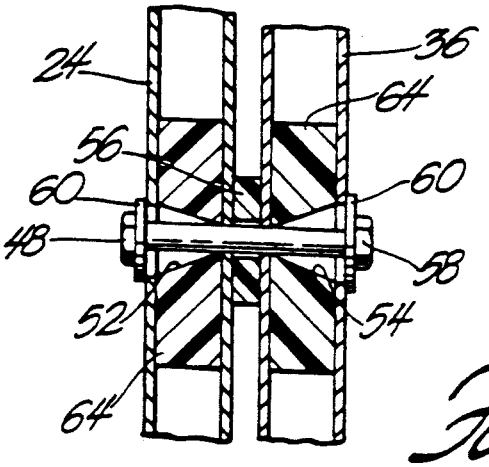
FIG. 6 is an enlarged sectional view of one of the two pivots between the V-shaped main frame and V-shaped seat support frame.

The V-shaped seat support frame 14 is positioned between the right and left legs 22 and 24 of the V-shaped main support frame 12 and the two V-shaped frames are pivotally attached to each other by pins 48 and 50. The pin 48 passes through a bore 52 through the left leg 24 of the V-shaped main support frame 12 and a bore 54 through the left arm 36 of the V-shaped seat support frame 14 as shown in FIG. 6. A washer 56 is provided between the left leg 24 and the left arm 36. The pin 48, as shown in FIG. 6 is a bolt with a lock nut 58 on one end. Washers 60 are provided on each end of the pin 48. The pin 50 passes through a bore 52 through the right leg 22 of the V-shaped main support frame 12 and a bore 54 through the right arm 34 of the V-shaped seat support frame 14. A washer 56 is provided between the right leg 22 and the right arm 34. The pin 50 is a bolt with a lock nut 62 on one end. Washers 60 are provided on each end of the pin 50.

Two pins 48 and 50 which pivotally connect two parts together must provide a common pivot axis. A common pivot axis is provided by employing conical bores 52 and 54 through the legs 22 and 24 and the arms 34 and 36 for the pins 48 and 50. The ends of the two conical bores 52 and 54 which are adjacent to each other have diameters that are slightly larger than the pin 48 as shown in FIG. 6. The other ends of the conical bores 52 and 54 are substantially larger than the ends of the bores which are adjacent to each other. This lets each of the pins float within the conical bores 52 and 54 and allows the V-shaped seat support frame 14 to pivot about a fixed axis relative to the V-shaped main support frame i.e. without binding the pins 48 and 50. Nylon blocks 64 are secured inside the left leg 24, the left arm 36, the right arm 34 and the right leg 22 to reinforce the tubular aluminum arms and legs where the pins 48 and 50 pass through the arms and legs. In addition to reinforcing the tubular aluminum arms 34 and 36 and the tubular aluminum legs 22 and 24, the nylon blocks 64 provide additional bearing surface for the pins 48 and 50. The blocks 64 could be polyvinyl chloride or other suitable material rather than nylon.

The third leg 16 passes through a space between the plate 38 and the plate 42. The third leg 16 also passes between the right arm 34 and the left arm 36 of the V-shaped seat support frame 14. When the three legged folding chair 10 is in a sitting position as shown in FIG. 4, a pin 66 is inserted through bores through the left arm 36 and the right arm 34 of the V-shaped seat support frame 14 and through the third leg 16. The pin 66 thereby locks the V-shaped seat support frame 14 in fixed position relative to the V-shaped main support frame 12. With the chair 10 in a sitting position, the right and left legs 22 and 24 of the V-shaped main frame 12 and the third leg 16 form a tripod. A plane through the right and left arms 34 and 36 of the V-shaped seat support frame 14 is generally perpendicular to a plane through the right and left legs 22 and 24 of the V-shaped main support frame 12.

Figure 7:
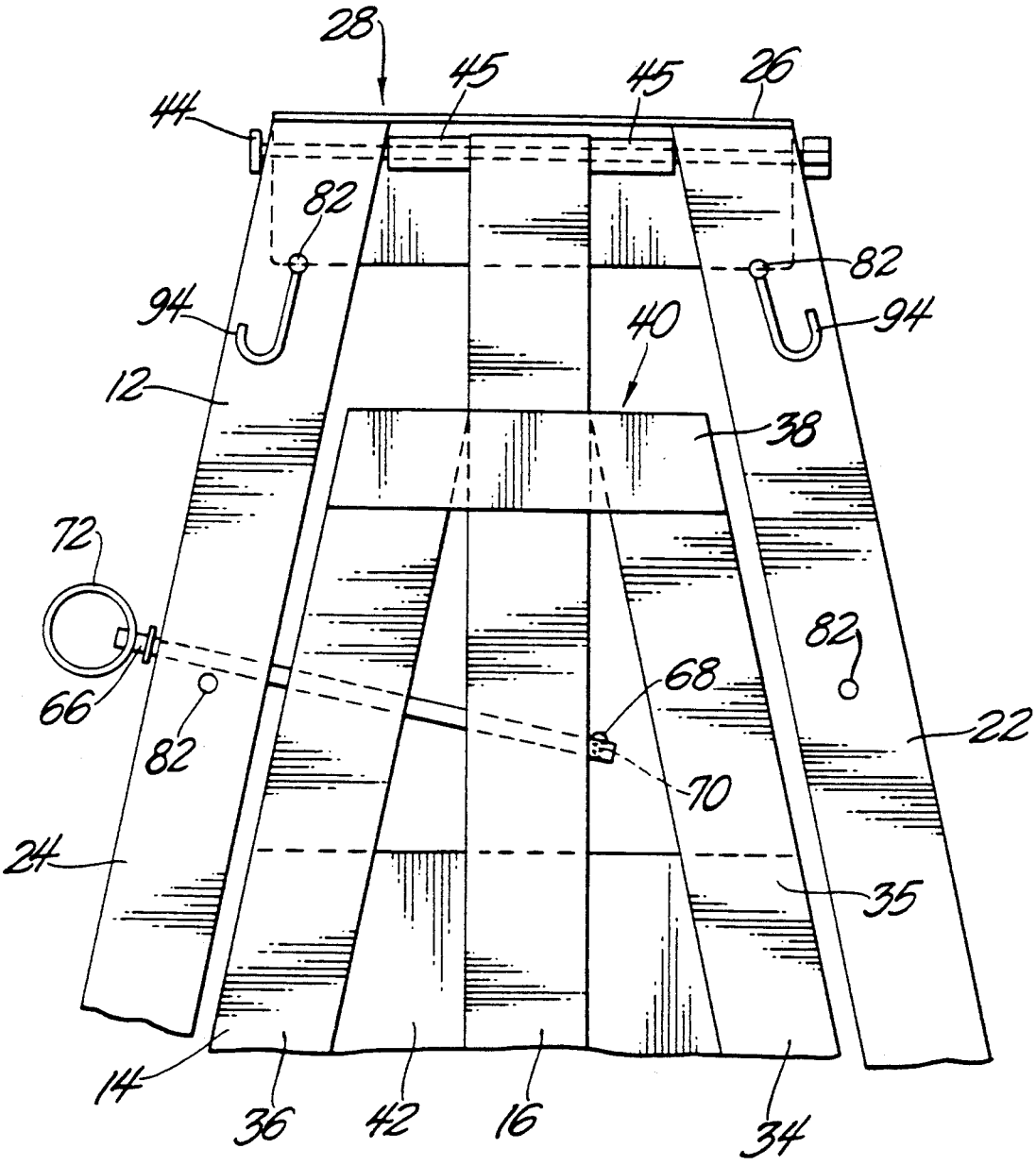
FIG. 7 is an enlarged view of the apex of both the V-shaped main support frame and the V-shaped seat support frame when the chair is folded into a transport condition.

Removal of the pin 66 from the position shown in FIG. 4 will allow the apex 40 of the V-shaped seat support frame 14 to pivot about an axis, formed by the pins 48 and 50, toward the apex 28 of the V-shaped main support frame 12. As the V-shaped seat support frame 12 pivots relative to the V-shaped main support frame 12, the third leg 16 pivots relative to the V-shaped main support frame about the axis of pin 44. The V-shaped seat support frame 14 and the third leg 16 are able to pivot relative to the V-shaped main support frame 12 to a transport position shown in FIGS. 1, 2 and 3 in which the third leg and the V-shaped main support frame are in contact with or close to a plane containing the upper surface 37 of the right and left arms 34 and 36 of the V-shaped seat support frame 14. In the transport position a flat side of the plate 38 is adjacent to one side of the third leg 16 and a flat side of the plate 42 is adjacent to another side of the third leg. The pin 66, as shown in FIG. 7 is inserted through apertures in the left leg 24 of the V-shaped main frame 12, through left arm 36 of the V-shaped seat support frame 14 and through the third leg 16. The pin 66 includes a retainer ball 68 loaded by a spring 70 and a pull ring 72. To remove the pin 66, a person pulls on the ring 72, the retainer ball 68 depresses the spring 70 and the pin 66 moves out of the apertures through the third leg 16, the left arm 36 and the left leg 24.

Figure 1:
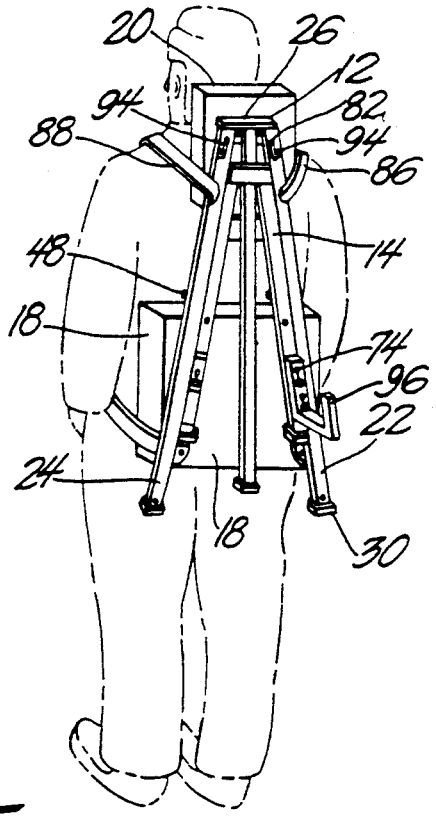
FIG. 1 is a perspective view of a three legged folding chair supported on the back of a person by shoulder straps in a folded condition.
Figure 2:
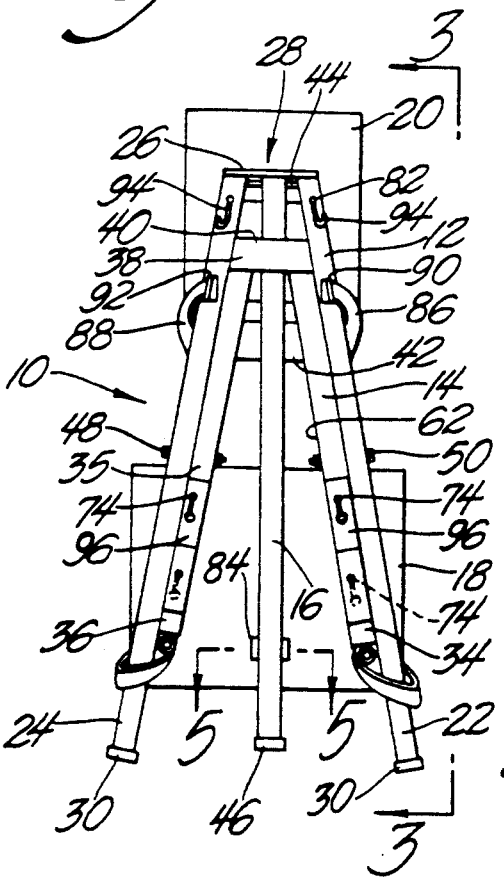
FIG. 2 is an enlarged rear elevational view of a three legged folding chair in a folded condition.

The support seat 18 is fastened to the upper surface 37 of the V-shaped seat support frame 14 by fasteners 74 as shown in FIGS. 1 and 2. The support seat 18 as shown in the drawing includes a rectangular plywood sheet 76, a foam rubber block 78, and a cloth cover 80. The backrest 20 is fastened to the upper portion of the V-shaped main frame 12 by fasteners 82. The backrest 20 is constructed from plywood, foam rubber and a cloth cover like the support seat 18 except that the foam rubber block is not as thick as the foam rubber block 78. The support seat 18 is attached to the opposite end of the V-shaped seat support frame 14 from the apex 40 and to one side of the pins 48 and 50 which pivotally attach the V-shaped seat support frame to the V-shaped main support frame 14. The backrest 20 is attached to V-shaped main support frame 12 adjacent to the apex 28.

The foam blocks 78 can be made from various materials that are commercially available. It has been found that urethane works well in warm weather. In cold weather it is desirable to use a material such as polystyrene or closed cell polyethylene. Polystyrene does not provide the cushioning obtained from urethane but does provide superior insulating. The insulating properties are very important to ice fisherman.

A spring steel clip 84 is secured to the bottom of the support seat 18. When the three legged folding chair 10 is in a folded position, the spring steel clip 84 frictionally engages and holds the third leg 16 in a fixed position relative to the support seat 18. Holding the third leg 16 in a fixed position relative to the support seat 18 keeps the third leg 16 from hitting the support seat and making noise while the chair 10 is being transported.

A right shoulder strap 86 and a left shoulder strap 88 are provided to allow the three legged folding chair to be carried like a backpack. The right shoulder strap 86 is attached to a shoulder strap ring 90 on the right leg 22 of the V-shaped main support frame 12 below the apex 28, and to the end of the right arm 34 of the V-shaped seat support frame 14 that is opposite the apex 40. The left shoulder strap 88 is attached to a shoulder strap ring 92 on the left leg 24 of the V-shaped main support frame 12 below the apex 28, and to the end of the left arm 36 of the V-shaped seat support frame 14, that is opposite the apex 40. Length adjustments are included but not shown for adjusting the length of right and left shoulder straps 86 and 88. Both shoulder straps 86 and 88 pass around the outside of the right and left legs 22 and 24 so that the shoulder straps 86 and 88 do not interfere with pivotal movement of the V-shaped seat support frame 14 relative to the V-shaped main support frame 12, when the three legged folding chair 10 is being carried by a person as shown in FIG. 1. The back rest 20 contacts the person's back between the shoulders and the support seat 18 contacts the lower portion of a person's back. The soft cushioned portions of the support seat 18 and the back rest 20 contact the person's back. The V-shaped frame members 12 and 14 and the third leg 16 are held away from and out of contact with a person carrying the chair by the back rest 20 and the support seat 18. The padding provided by the support seat 18 and the back rest 20 make it very comfortable to carry the chair 10 on the back with the shoulder straps 86 and 88.

Fisherman, hunters, campers and others engaged in outdoor activities often have more equipment to carry than a chair. Hooks 94 are attached to the right and left legs 22 and 24 of the V-shaped main support frame 12 just below the apex 28. Grommets on a backpack can be slipped onto the hooks 94 to attach the backpack to the chair. The hooks 94 as shown are attached to the right and left legs 22 and 24 by fasteners 82 as shown in the drawing. The hooks 94 can be positioned where needed and can be changed to D-rings or other types of hardware that are compatible with the container or equipment that is to be attached to the chair. Additional hooks 94, D-rings or other hardware can be attached to the chair if required.

Carrying brackets 96 can be attached to the V-shaped seat support frame if desired. The carrying brackets 96 can be used for attaching equipment such as tents to the chair.

If desired, carrying brackets for carrying special equipment can be substituted for the brackets 96. Such brackets can make it possible to safely carry fragile equipment or to permanently attach equipment that is to remain attached to the chair.

Nylon blocks 64 are secured inside the right and left legs 22 and 24 as shown in FIG. 6 to provide additional bearing surface for the pins 48 and 50 as explained above. Similar blocks are also provided for the pin 44, the pin 66, the fasteners 74 and the fasteners 82. The purpose of the nylon blocks used with the pins 44 and 46 is to provide additional bearing surface. The purpose of the nylon blocks used with fasteners 74 and 82 is to prevent the aluminum tubes from collapsing when the fasteners 74 or 82 are tightened. Nylon blocks are also secured inside the bottom ends of the right and left legs 22 and 24 and the third leg 16 to provide a flat support surface for the non-skid members 30 and 46. Nylon blocks are also used to close the ends of the right arm 34 and the left arm 36 of the V-shaped seat support frame 14.

While the invention has been described in detail, it will be apparent to those skilled in the art that the disclosed embodiment may be modified. Therefore, the foregoing description is to be exemplary rather than limiting and the true scope of the invention is that defined in the following claims.

I claim:

1. A foldable multipurpose chair with a primary frame comprising a generally V-shaped structure with a right leg and a left leg joined together at an apex; a secondary frame comprising a generally V-shaped structure with right arm and a left arm joined together at an apex; a pivot assembly pivotally connecting the secondary frame to the primary frame and operable to allow pivotal movement of the secondary frame between a position in which the secondary frame is generally in the same plane as the primary frame and is inside the outer periphery of the primary frame and a position in which the secondary frame is generally perpendicular to the primary frame; the pivot assembly including a bore through the right leg, a bore through the right arm, a pivot pin which passes through the bores through the right leg and the right arm, a bore through the left leg, a bore through the left arm and a pivot pin which passes through the bores through the left leg and the left arm, the bores through the right leg and the right arm being conical, the small diameter ends of bores through the right leg and the right arm being adjacent to each other, the bores through the left leg and the left arm being conical, and the small diameter ends of the bores through the left leg and the left arm being adjacent to each other; a third leg pivotally attached to the primary frame and having a mid-section that releasably supports the secondary frame when the secondary frame is pivoted relative to the primary frame to said position that is generally perpendicular to the primary frame; a back rest attached to the primary frame; and a support seat attached to the secondary frame.

2. A foldable multipurpose chair as set forth in claim 1 wherein the third leg extends between the right arm and the left arm when the secondary frame is generally in the same plane as the primary frame.

3. A three legged folding chair having a V-shaped main frame with an apex and two legs with free ends; a V-shaped seat support frame with an apex and two arms with free ends; a pivotal connection between the main frame and the seat support frame operable to permit pivotal movement of the seat support frame relative to the main frame, the pivotal connection between the V-shaped main frame and the V-shaped seat support frame including bores through the two main frame legs, bores through the two seat support frame arms, a first pivot pin passing through the bore through one main frame leg and the bore through one seat support frame, a second pivot pin passing through the bore through the other main frame leg and the bore through the other seat support frame and at least two of the bores have a larger diameter at one bore end than at the other bore end; a support seat secured to the portion of the seat support frame that is between the free ends of the two arms of the seat support frame and the pivotal connection between the V-shaped seat support frame and the V-shaped main frame; and a third leg attached to the V-shaped main frame and V-shaped seat support frame that forms a tripod in combination with the V-shaped main frame and locks the V-shaped seat support frame in a fixed position relative to the V-shaped main frame; and a release which is operable to unlock the V-shaped seat support frame and allow the V-shaped seat support frame to pivot relative to the V-shaped main support frame.

4. A three legged folding chair as set forth in claim 3 including a back rest attached to the V-shaped main frame adjacent to the V-shaped main frame apex.

5. A three legged folding chair as set forth in claim 4 including a right shoulder strap and a left shoulder strap each attached to at least one of the frame members and operable to support the folding chair on the back of a person with the back rest and the support seat in contact with said person.

6. A three legged folding chair as set forth in claim 5 including attaching hardware on at least one of the frame members for the attachment of a back-pack.

7. A three legged folding chair as set forth in claim 5 including attaching hardware on at least one of the frame members for attaching equipment that is to be transported with the three legged folding chair.

8. A three legged folding chair having a V-shaped main frame with an apex and two legs with free ends; a V-shaped seat support frame with an apex and two arms with free ends; a pivotal connection between the main frame and the seat support frame located between the apex and the free ends of the two legs of the V-shaped main frame, and between the apex and the free ends of the two arms of the V-shaped seat support frame, operable to permit pivotal movement of the seat support frame relative to the main frame; wherein the pivotal connection between the V-shaped main frame and the V-shaped seat support frame including bores through the two main frame legs, bores through the two seat support frame arms, a pivot pin passing through the bore in one of the main frame leg and the bore through an adjacent one of the seat support frame arm, a pivot pin passing through the bore in the other main frame leg and the bore through an adjacent other one the seat support frame arm and wherein the bores through the two main frame legs are conical; a support seat secured to the portion of the seat support frame that is between the free ends of the two arms of the seat support frame and the pivotal connection between the V-shaped seat support frame and the V-shaped main frame; and a third leg attached to the V-shaped main frame and V-shaped seat support frame that forms a tripod in combination with the V-shaped main frame and locks the V-shaped seat support frame in a fixed position relative to the V-shaped main frame; and a release which is operable to unlock the V-shaped seat support frame and allow the V-shaped seat support frame to pivot relative to the V-shaped main support frame.

9. A three legged folding chair as set forth in claim 8 wherein the bores through the two seat support frame arms are conical.

10. A three legged folding chair as set forth in claim 8 including a back rest secured to the portion of the V-shaped main frame that is between the apex of the V-shaped main frame and the pivotal connection between the V-shaped seat support frame and the V-shaped main frame.

11. A three legged folding chair having a V-shaped main frame with an apex and two legs with free ends; a V-shaped seat support frame with an apex and two arms with free ends; a pivotal connection between the main frame and the seat support frame, located between the apex and the free ends of the two legs of the V-shaped main frame and between the apex and the free ends of the two arms of the V-shaped seat support frame, operable to permit pivotal movement of the seat support frame relative to the main frame and wherein the pivotal connection between the V-shaped main frame and the V-shaped seat support frame includes bores through the two main frame legs, bores through the two seat support frame arms, a pivot pin passing through the bore in one of the main frame leg and the bore through an adjacent one of the seat support frame arm, a pivot pin passing through the bore in the other main frame leg and the bore through an adjacent other one the seat support frame arm and wherein the bores through the two seat support frame arms are conical; a support seat secured to the portion of the seat support frame that is between the free ends of the two arms of the seat support frame and the pivotal connection between the V-shaped seat support frame and the V-shaped main frame; a third leg attached to the V-shaped main frame and V-shaped seat support frame that forms a tripod in combination with the V-shaped main frame; and a lock operable to lock the V-shaped seat support frame in a fixed position relative to the V-shaped main frame and to unlock the V-shaped seat support frame and allow the V-shaped seat support frame to pivot relative to the V-shaped main support frame.

12. A three legged folding chair as set forth in claim 11 including a back rest secured to the portion of the v-shaped main frame that is between the apex of the V-shaped main frame and the pivotal connection between the V-shaped seat support frame and the V-shaped main frame.

13. A three legged folding chair comprising a V-shaped main frame with an apex and two legs with free ends; a V-shaped seat support frame with an apex and two arms with free ends and wherein the two arms are spaced apart and rigidly secured to each other at the apex by a first structural member including a flat plate; a pivotal connection between the V-shaped main frame and the V-shaped seat support frame between the apex and the free ends of the two legs of the V-shaped main frame and between the apex and the free ends of the two arms of the V-shaped seat support frame operable to permit pivotal movement of the V-shaped seat support frame relative to the V-shaped main frame; a support seat secured to the portion of the V-shaped seat support frame that is between the free ends of the two arms of the V-shaped seat support frame and the pivotal connection between the V-shaped seat support frame and the V-shaped main frame; and a third leg pivotally attached to the V-shaped main frame and extending between the two spaced apart arms of the V-shaped seat support frame and between the first structural member and the support seat and wherein the first structural member permits the folding chair to fold into a position in which the V-shaped seat support frame and the third leg are in a common plane with the support seat on one side of the third leg and with a portion of the first structural member between the two arms of the V-shaped seat support frame adjacent to the side of the third leg opposite said one side; and a lock operable to lock the V-shaped seat support frame in at least one fixed position relative to the V-shaped main frame and operable to release the V-shaped seat support frame to allow pivotal movement of the V-shaped seat support frame relative to the V-shaped main frame and movement of the third leg between the two spaced apart arms of the V-shaped seat support frame.

14. A three legged folding chair as set forth in claim 13 wherein the V-shaped seat support frame includes a second structural member secured to the two arms of the V-shaped seat support frame between the first structural member and the pivot connection between the V-shaped main frame and the V-shaped seat support frame and spaced from the first structural member to allow the third leg to extend between the first structural member and the second structural member.

15. A three legged folding chair as set forth in claim 13 including a back rest attached to surfaces on the two legs of the V-shaped main frame that are between the apex of the main frame and the pivotal connection between the V-shaped main frame and the V-shaped seat support frame and wherein the free ends of the two legs of the V-shaped main frame have chair support surfaces that contact a surface the chair is sitting upon when in use and that extend forward from a plane through the surfaces on the two legs of the V-shaped main frame to which the back rest is attached.

16. A three legged folding chair as set forth in claim 13 including a back rest attached to the V-shaped main frame with a lower edge of the back rest below the apex of the main frame and between the apex of the main frame and the pivotal connection between the V-shaped main frame and the V-shaped seat support frame, and with an upper edge of the back rest above the apex of the V-shaped main frame in the folded position.

17. A three legged folding chair as set forth in claim 13 including a right shoulder strap and a left shoulder strap each attached to at least one of the frame members and operable to support the folding chair on the back of a person with the support seat in contact with the lower back and the back rest in contact with the upper back of the person and preventing contact between the apex of the V-shaped main frame and a person carrying the folding chair with the right and left shoulder straps over the shoulders.

18. A three legged folding back pack chair as set forth in claim 13 including openings in the V-shaped main frame and in the V-shaped seat support frame that receive a pin of substantially the same size to lock the folding chair in a folded position.

19. A three legged folding back pack chair as set forth in claim 13 including openings in the V-shaped seat support frame and in the third leg that receive a pin of substantially the same diameter to lock the folding chair in said position.

20. A three legged folding chair comprising a V-shaped main frame with an apex and two legs with free ends; a V-shaped seat support frame with an apex and two arms with free ends and wherein the two arms are spaced apart and rigidly secured to each other at the apex by a first structural member and a second structural member secured to the two arms of the V-shaped seat support frame between the first structural member and a pivot connection between the V-shaped main frame and the V-shaped seat support frame and spaced from the first structural member to allow a third leg to extend between the first structural member and the second structural member; said pivotal connection between the V-shaped main frame and the V-shaped seat support frame located between the apex and the free ends of the two legs of the V-shaped main frame and between the apex and the free ends of the two arms of the V-shaped seat support frame operable to permit pivotal movement of the V-shaped seat support frame relative to the V-shaped main frame; a support seat secured to the portion of the V-shaped seat support frame that is between the free ends of the two arms of the V-shaped seat support frame and the pivotal connection between the V-shaped seat support frame and the V-shaped main frame; and the third leg pivotally attached to the V-shaped main frame and extending between the two spaced apart arms of the V-shaped seat support frame and between the first structural member and the support seat and wherein the first structural member permits the folding chair to fold into a position in which the V-shaped seat support frame and the third leg are in a common plane with the support seat on one side of the third leg and with a portion of the first structural member between the two arms of the V-shaped seat support frame adjacent to the side of the third leg opposite said one side; and a lock operable to lock the V-shaped seat support frame in at least one fixed position relative to the V-shaped main frame and operable to release the V-shaped seat support frame to allow pivotal movement of the V-shaped seat support frame relative to the V-shaped main frame and movement of the third leg between the two spaced apart arms of the V-shaped seat support frame.

* * * * *